US009162270B2

(12) United States Patent
Chazal et al.

(10) Patent No.: US 9,162,270 B2
(45) Date of Patent: Oct. 20, 2015

(54) METHOD FOR MODIFYING THE DISTANCE BETWEEN THE ROLLERS OF A LEVELING MACHINE, LEVELING MACHINE, AND APPARATUS FOR IMPLEMENTING SAID METHOD

(75) Inventors: Jean-Pierre Chazal, Trelins (FR); Bernard Dumas, Montbrison (FR); Vincent Philippaux, Montbrision (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 1091 days.

(21) Appl. No.: 13/203,251

(22) PCT Filed: Mar. 13, 2009

(86) PCT No.: PCT/EP2009/001871

§ 371 (c)(1),
(2), (4) Date: Nov. 3, 2011

(87) PCT Pub. No.: WO2010/097100

PCT Pub. Date: Sep. 2, 2010

(65) Prior Publication Data

US 2012/0055220 A1 Mar. 8, 2012

(30) Foreign Application Priority Data

Feb. 25, 2009 (EP) ..... 09290133

(51) Int. Cl.
*B21D 1/02* (2006.01)

(52) U.S. Cl.
CPC ..... *B21D 1/02* (2013.01)

(58) Field of Classification Search
CPC ..... B21B 31/03; B21B 31/08; B21B 31/10; B21B 31/12; B21B 2031/023; B21D 1/02; B21D 3/02; B21D 3/05; B21D 37/04; B21D 37/14; B21D 37/147
See application file for complete search history.

(56) References Cited

U.S. PATENT DOCUMENTS

| | | | | |
|---|---|---|---|---|
| 3,555,871 | A * | 1/1971 | Hlafscak | 72/239 |
| 4,487,603 | A | 12/1984 | Harris | |
| 4,641,511 | A * | 2/1987 | Poloni | 72/160 |
| 5,127,250 | A | 7/1992 | Nagata | |
| 6,354,127 | B1 * | 3/2002 | Rossini | 72/164 |

FOREIGN PATENT DOCUMENTS

| | | |
|---|---|---|
| EP | 1 584 384 A1 | 10/2005 |
| GB | 1 179 948 | 2/1970 |
| JP | 54046280 A | 4/1979 |
| JP | 59131356 A | 7/1984 |

(Continued)

*Primary Examiner* — Teresa M Ekiert
(74) *Attorney, Agent, or Firm* — Laurence A. Greenberg; Werner H. Stemer; Ralph E. Locher

(57) ABSTRACT

A machine for leveling a strip of material includes a fixed supporting frame; an upper leveling device and a lower leveling device, each leveling device forming a cassette with a plurality of separated rollers, rotatably mounted on a frame of a device for rotating the rollers connected to at least some of the rollers by an extender, each extender having one end provided with a removable coupling member with one end for rotating the roller, and a device for locking each removable coupling member by clamping. The clamping locking device includes a device configure for translating the removable coupling members in the direction of travel of the material, and in the opposite direction.

24 Claims, 9 Drawing Sheets

(56) References Cited

FOREIGN PATENT DOCUMENTS

| | | | |
|---|---|---|---|
| JP | 02106569 | A | 4/1990 |
| JP | 10258316 | A | 9/1998 |
| UA | 9279 | U | 9/2005 |
| WO | 2008/099126 | A2 | 8/2008 |

* cited by examiner

METHOD FOR MODIFYING THE DISTANCE BETWEEN THE ROLLERS OF A LEVELING MACHINE, LEVELING MACHINE, AND APPARATUS FOR IMPLEMENTING SAID METHOD

BACKGROUND OF THE INVENTION

Field of the Invention

The invention relates to the field of leveling thick metal strips or plates. It relates in particular to a method for modifying the distance between the rollers of leveling devices installed in a leveling machine. It also relates to a leveling machine and an apparatus providing for the implementation of the method.

The thick strips are leveled by a succession of alternating flexions of decreasing amplitude without any application of external traction upstream or downstream of the leveling machine. These leveling machines comprise two leveling devices, each carrying a series of rollers with parallel axes placed respectively above and below the strip, the rollers being offset longitudinally and vertically so as to be nested, thus determining an undulating path for the strip, which is thereby subjected to successive alternating flexion effects. These alternating flexions are reflected in curves generated in the strip, deformations varying from a state of traction on the upper surface of the curve to a state of compression on the lower surface, passing through a zero value in the median axis or "neutral fiber" of the strip, according to a law of linear variation. Depending on the amplitude of the curve, the stresses thus generated may exceed the elastic limit of the strip over a greater or lesser fraction of its thickness. This plasticization is a decisive element in the elimination of evenness defects which cannot be drawn out, such as "long edges", "long centers", etc. The plasticized fraction of the thickness of a strip is usually expressed as a percentage of the total thickness designated by the term "plasticization rate".

Control of the leveling operation depends on control of the curves generated at each alternating flexion, control which comes up against two difficulties. First of all, modeling the curve as a function of the thickness of the strip, the nesting of the upper rollers between the lower rollers and the separation of the rollers. In order to make this modeling more precise, attempts have always been made to arrange the successive lower and upper rollers according to a simple geometry, placing their axes at the apexes of successive isosceles triangles. Next, the extent of the "give" in the leveling machine under the effect of the separating forces between the lower and upper rollers, give which is taken into account in applying the squeezing forces of the rollers. Such leveling machines have been known for a long time and described in numerous documents. For example, the applicant's patent application WO2008/099126 may be cited.

Generally speaking, each leveling device, respectively lower or upper, comprises a plurality of rollers with parallel axes which normally have a reduced diameter and are therefore held by at least two supporting rollers, which may themselves rest on rows of wheels, the set of these rollers and wheels being assembled on a frame.

These two leveling devices, placed respectively below and above a horizontal plane of travel of the strip, are placed in a supporting frame comprising four columns arranged on each side of the longitudinal axis of travel of the strip, and firmly held in their lower part by a fixed base and in their upper part by transverse beams, the assembly forming a closed frame.

The lower leveling device rests on the fixed base and the upper device rests on a pressure frame which can be moved vertically between the four columns by means of mechanical or hydraulic jacks resting on the upper part of the frame so as to adjust the separation of the two leveling devices and, consequently, the nesting of the rollers, while taking up the separating forces due to the resistance of the product. Usually, at least some of the leveling rollers are rotated about their axes in order to advance the strip by friction at a determined speed following an undulating path between the lower and upper rollers.

The diversity of the standard formats of rolled strips on the market is such that a single apparatus may have to produce and level strips whose thickness may vary within a very broad range, for example from 5 to 50 mm or more. In a traditional isosceles triangle arrangement of three leveling rollers, it is found that, for the same pitch and the same nesting of the rollers, the radius of curvature of a thick strip is very much smaller than that of a less thick strip and thus results in a far greater plasticization rate. Hence, for a given plasticization rate and everything else being equal, the required accuracy of nesting is therefore necessarily greater for a thick strip than for a thin strip.

For this reason, attempts have long been made to make at least one of the parameters governing the curve of the strip variable independently of the adjustment of the nesting and so attempts have been made to vary the separation or "pitch" of the rollers.

Thus, document JP 62-203616 describes a change of pitch of the upper and lower rollers of a leveling machine by vertical retraction of one in two rollers. The upper rollers are retracted vertically upwards while the lower rollers are retracted vertically downwards. In order to retain a traditional isosceles triangle arrangement for said upper and lower rollers, the lower leveling device is actuated with a horizontal movement in the longitudinal direction of the strip.

Document JP 50-57350 discloses a leveling machine in which the lower and upper devices are movable in the longitudinal direction of the strip.

The solutions described by these two documents allow the pitch between the leveling rollers to be multiplied by two but at the expense of a lower leveling device movement mechanism which is greatly exposed to wear due to carbon deposits detached during leveling of hot-rolled strips.

Document U.S. Pat. No. 5,127,250 proposes a leveling machine in which every other lower roller is carried by a frame suitable for moving vertically between a low position where all the lower working rollers are in contact on the one hand with the same face of the strip and on the other hand with the lower supporting rollers and a high position where the raised working rollers are in contact with the opposite face of the strip on the one hand and on the other hand with the upper working rollers acting as supporting rollers.

However, the device described in these documents only allows for one change of configuration between a given pitch and the double of it, without any possibility for more appropriate intermediate values, and also does not permit any change in the diameter of the rollers.

Publication EP 0 551 658 proposes vertically moving certain rollers in a leveling device so that they are not in contact with the strip, thus varying the pitch of the rollers. The method disclosed in this document consists in moving at least a pair of consecutive upper and lower rollers. This creates spaces of three pitches between some active rollers together or alternately with spaces of one single pitch between other active rollers. In the case of thick strips, such an arrangement does not resolve the problems of inaccurate nesting of the rollers separated by a single pitch and, on the other hand, does not make it possible to retain the isosceles triangle arrangement, which provides for more accurate modeling of the curves.

Publication EP 1 584 384 proposes arranging several types of upper and lower leveling devices carrying a different number of rollers with different diameters and including geared distribution systems in order to pass from one number of rollers to the other with a single motor drive. This arrangement has the major disadvantage of quite considerably increasing the size of the devices, which include transmission shafts and geared distribution boxes, which, for reasons of space available inside said devices, can only be designed to transmit modest torque, as indicated by the small strip thicknesses and the small roller diameters cited in this document.

BRIEF SUMMARY OF THE INVENTION

This invention proposes resolving the problems in the prior art by proposing a leveling method, machine and apparatus comprising new means and new stages of modification of the relative position of the leveling device rollers continuously over a whole range of values, while retaining the isosceles triangle arrangement, which allows for more accurate modeling of the curves. It is thus possible most accurately to adjust the separation between the leveling rollers as a function of the characteristics and in particular the thickness of the material to be leveled.

To this end, the first object of this invention is a leveling machine for a strip of material comprising:

- a fixed supporting frame comprising four posts situated on each side of the longitudinal axis of travel of the material and firmly held in their lower part by a fixed base and in their upper part by transverse beams, the assembly forming a closed frame,
- a lower leveling device resting on the fixed base and an upper leveling device resting on a pressure frame which can be moved vertically between the four posts, each leveling device forming a cassette comprising a plurality of separated rollers, rotatably mounted on a frame around axes perpendicular to the longitudinal axis of travel of the material,
- means for rotating the rollers connected to at least some of the rollers by an extender, each extender having a first end rotated and a second end fitted with a removable coupling member with one end driving a roller, said extenders being arranged on two levels, respectively a lower level coupling with the rollers of the lower device and an upper level coupling with the rollers of the upper device,
- means for locking each removable coupling member by clamping at a predetermined height during device changing phases,
- means for dismantling each of the two leveling devices in the form of cassettes by moving, perpendicular to the axis of travel, between a working position inside the frame and a withdrawn position offset laterally on one side of the frame opposite the drive side, characterized in that the means of locking by clamping comprise means suitable for translationally moving the removable coupling members in the direction of travel of the material and in the opposite direction.

According to other characteristics of this invention,

- the means suitable for moving the removable coupling members comprise a plurality of elements translationally moving between two end positions, intended for moving the removable coupling members,
- the means of locking by clamping comprise:
  - an upper clamping crosspiece carrying on its lower horizontal face a first set of translationally moving elements,
  - a lower clamping crosspiece carrying on its upper horizontal face a second set of translationally moving elements and
  - an intermediate clamping crosspiece carrying on its upper horizontal face a third set of translationally moving elements and carrying on its lower horizontal face a fourth set of translationally moving elements, the intermediate crosspiece being positioned between the lower and upper crosspieces,
- the moving elements each comprise a moving bearer suitable for sliding on a sliding surface of the crosspiece supporting it, each bearer carrying at least one clamping cradle intended for clamping a removable coupling member,
- each moving element comprises a nut integral with the bearer of the moving element, the nuts belonging to the same set of moving elements being moved by a single screw, the screw being actuated by a rotating member,
- the screw comprises, for each nut it guides, a threaded drive section of a predetermined length, each section comprising a pitch and an inclination such that two moving bearers situated at an equal distance from a point on the screw and on both sides of that point move, moving closer or further apart symmetrically with respect to that point when the screw is actuated,
- the pitch and inclination of the threads are such that, when the screw is rotated in one direction, the bearers of one set move further apart while retaining their equal relative separation and, when the screw is rotated in the other direction, the bearers of one set move closer together while retaining their equal relative separation,
- the upper and lower crosspieces are translationally guided by two fixed vertical axes comprising at their respective ends supports fixed to two of the posts of the leveling machine, the intermediate crosspiece horizontally rotating about one of the guide axes of the other crosspieces between a working position in which it extends in a plane passing through the fixed vertical axes and a resting position in which it extends outside the plane passing through the fixed vertical axes,
- in the working position of the intermediate clamping crosspiece, each moving element of the first set of moving elements is placed opposite a moving element of the third set of moving elements and each moving element of the second set of moving elements is placed opposite a moving element of the fourth set of moving elements, the rotating member of each screw being controlled so that the moving elements placed directly opposite move simultaneously the same distance and in the same direction in order translationally to drive a removable coupling member,
- each clamping crosspiece comprises a hollow part forming a protective casing for a portion of the moving elements it is supporting,
- at least two of the clamping crosspieces comprise a fixed cradle situated on a sliding surface of each of said clamping crosspieces in the middle of the moving elements, each clamping cradle being positioned to come opposite another fixed clamping cradle when the clamping crosspieces are in working position,
- the upper clamping crosspiece and the lower clamping crosspiece comprise at each of their ends a hollow cylinder accepting fixed vertical axes acting as a translational guide for the upper and lower crosspieces, the lower leveling device comprises at least four beams extending vertically from the lower frame and terminated in their upper part by pins, the upper leveling device comprising at least two pin plates, each plate being pierced by at least one borehole, the pins of the lower leveling device being suitable for being inserted into the boreholes of the upper leveling device to provide for docking of the upper leveling device with the lower leveling device during the phases of extraction, introduction and transfer of the leveling devices.

Another object of the invention is a method for modifying the distance between the rollers of leveling devices installed in a leveling machine, the leveling machine comprising:

a fixed supporting frame comprising four posts situated on each side of the longitudinal axis of travel of the material and firmly held in their lower part by a fixed base and in their upper part by transverse beams, the assembly forming a closed frame, a lower leveling device resting on the fixed base and an upper leveling device resting on a pressure frame which can be moved vertically between the four posts, each leveling device forming a cassette comprising a plurality of separated rollers, rotatably mounted on a frame around axes perpendicular to the longitudinal axis of travel of the material, means for rotating the rollers connected to at least some of the rollers by an extender, each extender having a first end rotated and a second end fitted with a removable coupling member with one end driving a roller, said extenders being arranged on two levels, respectively a lower level coupling with the rollers of the lower device and an upper level coupling with the rollers of the upper device, means for locking each removable coupling member by clamping at a predetermined height during device changing phases, means for dismantling each of the two leveling devices in the form of cassettes by moving, perpendicular to the axis of travel, between a working position inside the frame and a withdrawn position offset laterally on one side of the frame opposite the drive side, characterized in that the method comprises:

a stage of clamping each removable coupling member providing for the transmission of torque to the leveling rollers to keep them at a predetermined height, a stage of extracting the old leveling devices from the leveling machine, during which each end driving a roller is extracted from its removable coupling member, a stage during which each removable coupling member is translationally moved in the direction of travel of the material or in the opposite direction, from a position corresponding to the position of coupling with one of the rollers of an old leveling device to a new position of coupling with one of the rollers of a new leveling device, a stage of introduction of the new leveling devices into the leveling machine during which each end driving a new roller is engaged in a removable coupling member, a stage of releasing the removable coupling members.

According to other characteristics of the method:

prior to the stage of clamping the removable coupling members, a stage of stopping the rotation of the leveling rollers is implemented, the stage of clamping the removable coupling members comprises:

a stage B during which the upper device rises from its working position to a high position and during which an intermediate clamping crosspiece is taken from its resting position to a working position in which the intermediate clamping crosspiece extends in a plane passing through two fixed vertical translational guide axes of the other crosspieces, a stage C during which a lower clamping crosspiece of the leveling machine rises to contact the lower removable coupling members and during which the intermediate crosspiece descends to come into contact with the same lower coupling members thus providing for clamping of the lower coupling members, a stage D during which the upper leveling device descends to provide for contact between the upper coupling members and the intermediate clamping crosspiece and during which the upper clamping crosspiece descends to come into contact with the same upper coupling members thus providing for clamping of these upper coupling members, the method comprises a stage C prior to stage D during which the lower leveling device is translationally moved perpendicular to the direction of travel of the material, for example by a means of extraction, from its working position to an intermediate position in which pins of the lower leveling device are opposite boreholes of the upper leveling device, the stage of extraction of the old leveling devices out of the leveling machine comprises:

a stage E1 during which locking devices are opened, thus releasing the pressure frame and the upper leveling device and during which the pressure frame rises again, a stage E2 during which the upper and lower leveling devices are pushed by a means of extraction to a transfer device, which brings about the extraction of the ends driving the leveling rollers out of the removable coupling members, the stage during which each removable coupling member is moved comprises a stage E0 of movement of a plurality of moving elements belonging to each of the clamping crosspieces, each moving element accepting a removable coupling member, the movement of each moving element being from a position corresponding to the position for coupling the removable coupling member with one of the rollers of the old leveling devices to a new position for coupling the removable coupling member with one of the rollers of the new leveling devices, the stage of introduction of the new leveling devices into the leveling machine comprises:

a stage E3 during which a transfer jack pushes an assembly comprising two transfer devices carrying respectively leveling devices which are worn or not suitable for leveling a strip of material emerging from the leveling machine and new leveling devices on rails until the transfer device carrying the new leveling devices is in the extension of the fixed base of the leveling machine, a stage E4 during which the new upper and lower leveling devices are drawn by means of extraction from a storage position to a working position on the fixed base of the leveling machine until the ends driving the new leveling rollers are introduced into the removable coupling members, a stage E5 during which the pressure frame descends again and during which the new upper leveling device is firmly attached to the pressure frame by means of the locking devices, the stage of release of the removable coupling members comprises:

a stage F during which the upper clamping crosspiece rises again to a resting position, thus releasing the upper coupling members and during which the new upper device also rises again, driven by the pressure frame, a stage G during which the intermediate clamping crosspiece rises again to its resting position and then pivots about its axis of rotation, a stage H during which the lower clamping crosspiece descends to its resting position and during which the new upper leveling device descends to its working position, the stage of introduction of the new leveling devices into the leveling machine comprises:

a stage E3 during which a transfer jack pushes an assembly comprising two transfer devices carrying respectively leveling devices which are worn or not suitable emerging from the leveling machine and new leveling devices on rails until the transfer device carrying the new leveling devices is in the extension of the fixed base of the leveling machine, a stage E4', during which the new lower and upper leveling devices pinned together are pushed onto the fixed base of the leveling machine until the ends driving the upper leveling rollers are introduced into the upper removable coupling members, a stage E5' during which the pressure frame descends again and during which a new upper leveling device is firmly attached to the pressure frame by means of the locking devices, the stage of release of the removable coupling members comprises:

a stage F' during which the upper clamping crosspiece rises again to a resting position, thus releasing the upper coupling members and during which the new upper device also rises again, driven by the pressure frame, a stage F" during which the new lower leveling device is translationally moved perpendicular to the direction of travel of the strip from its dismantling position until the ends driving the lower leveling rollers are introduced into the lower removable coupling members, a stage G during which the intermediate clamping crosspiece rises again to its resting position and then pivots about its axis of rotation, a stage H during which the lower clamping crosspiece descends to its resting position and during which the new upper leveling device descends to its working position.

Another object of the invention is a leveling apparatus comprising a leveling machine as defined above, the leveling apparatus comprising:

a first transfer device intended to accept leveling devices which are worn or inappropriate for leveling the next material (M) originating from the leveling machine, a second transfer device transporting a new set of upper and lower leveling devices coupled to the first transfer device by means of a coupling, a jack in contact with the transfer device suitable for moving the set of two transfer devices from a position in which the first transfer device is installed in the extension of the fixed base on rails to a position in which the second transfer device carrying the new leveling devices is in the extension of the fixed base of the leveling machine.

Other characteristics and advantages of this invention will become apparent upon reading a detailed, non-restrictive embodiment, referring to the figures in which:

DESCRIPTION OF THE INVENTION

Figure 1:
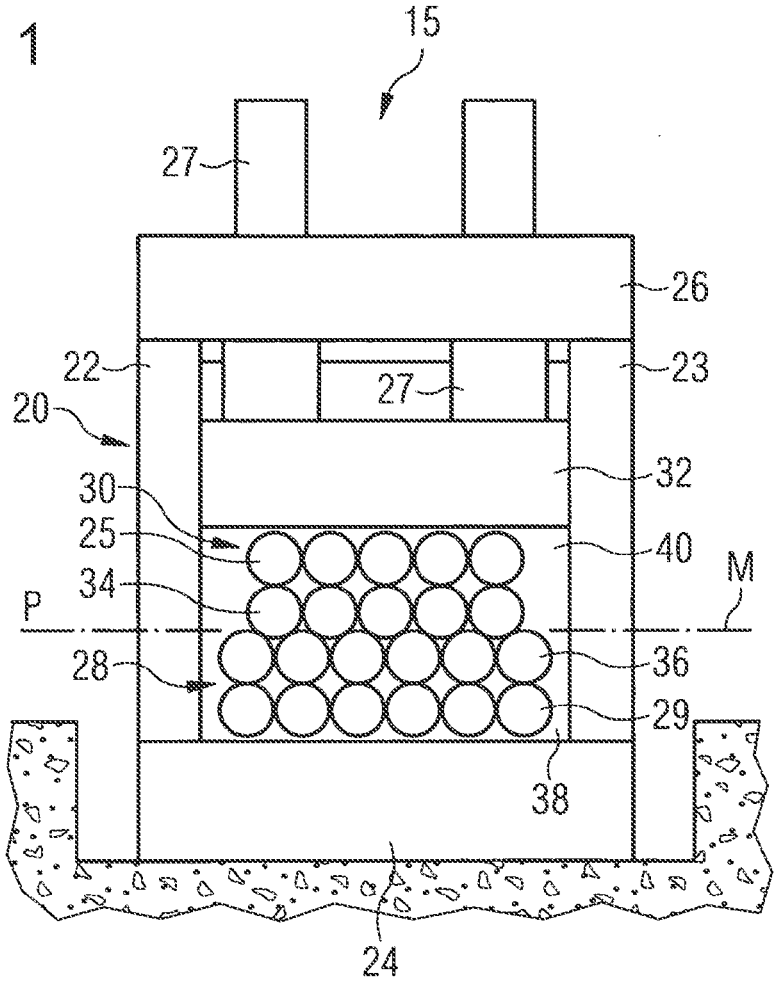
FIG. 1 is a schematic side view of a leveling machine.
Figure 2:
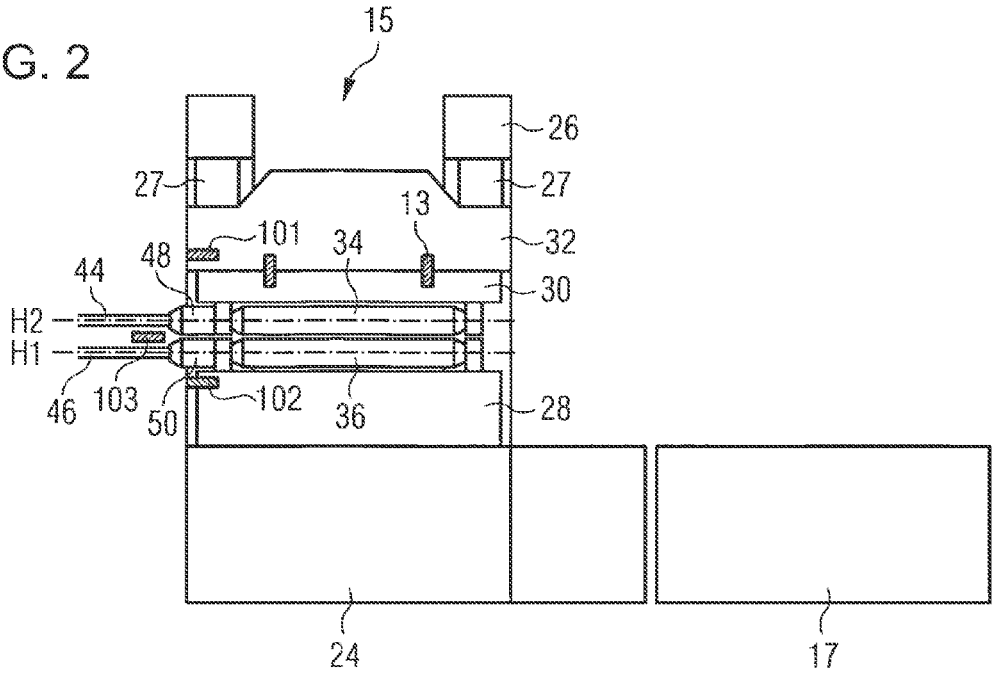
FIG. 2 is a schematic front view of a leveling machine.

FIGS. 1 and 2 schematically represent a side and front view of the assembly of a leveler with multiples rollers 15 comprising two leveling devices 28 and 30 placed on each side of a horizontal axis P of travel of a material M inside a supporting frame 20 comprising four posts 22 (only two of which are visible in FIG. 1) fixed at their base by a fixed base 24 resting on the foundation block and linked in their upper part by transverse beams 26.

The upper device 30 carries a plurality of leveling rollers 34 with parallel axes, separated from one another, and each resting at least on one supporting roller 25, the rollers 34 being mounted rotatably, about their respective axes, on a frame 40 which rests on a pressure frame 32 and is connected to it, in a removable manner, by fixing means (not represented in FIG. 1). The level of the pressure frame 32 and consequently of the upper leveling device 30 can be adjusted using jacks 27, mechanical or hydraulic, resting on the transverse beams 26.

Similarly, the lower device 28 comprises a plurality of leveling rollers 36 resting on supporting rollers 29, said rollers being mounted rotatably, about their parallel axes, on a supporting frame 38 which rests on the base 24.

The upper 34 and lower 36 leveling rollers are offset in the direction of travel of the material M so as to produce an undulating path for the material M, the nesting of them being able to be adjusted by the jacks 27.

Figure 3:
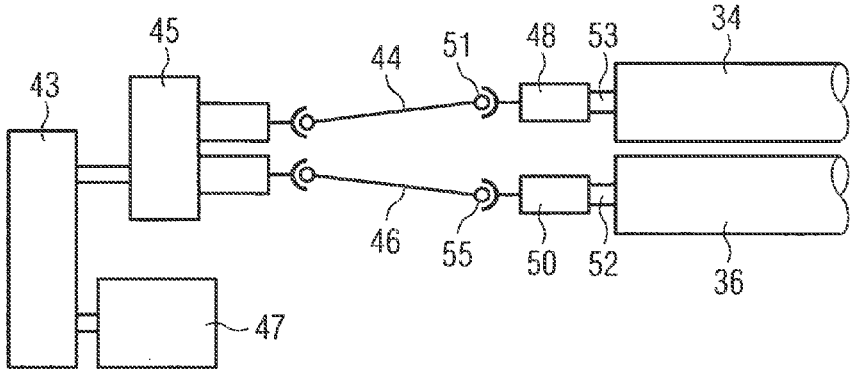
FIG. 3 is a schematic view of the leveling roller rotation device.

In order to produce the desired traction-flexion effects on the product M, the product has to run longitudinally between the rollers and, for this purpose, is driven by friction, by at least some of the leveling rollers 34, 36, which are rotated by a motorized assembly comprising for example, as represented schematically in FIG. 3, one or more motors 47 driving one or more speed reducers 43 which actuate at the required speed one or more gearboxes 45 distributing the torque to the different upper 34 and lower 36 working rollers through the upper 44 and lower 46 extenders with two ends connected respectively, by universal joints 51, 55, on one side to the end spindles 52, 53 of the leveling rollers 34, 36 and on the other to the outputs from the gearbox 45. Usually, leveling machines for sheets or strips of great thickness comprise, as the case may be, seven to eleven leveling rollers. For example, as represented in FIGS. 1 and 2, the upper device 30 can carry five rollers 34 and the lower device 28, six rollers 36. Such machines applied to strips and plates of great width and thickness may reach a mass of more than 300 metric tons with a height of over 10 meters, the leveling device possibly itself having a mass of several tens of metric tons.

During the leveling operation, the rollers are subjected to high surface pressure stresses and abrasion phenomena which require reconditioning, for example machining by grinding their active surfaces, in a maintenance workshop.

The leveling devices must therefore be able to be dismantled and, for this purpose, each universal joint 51, 55 placed at the end of an extender 44, 46 is connected to the spindles 52, 53 of the working rollers 34, 36 by a removable coupling member 48, 50 which, in the example represented, may be an internally grooved sleeve, in which the spindle 52, 53 of the roller 34, 36 fitted with corresponding splines engages by axial sliding.

Furthermore, each leveling device, respectively upper 30 or lower 28 forms a cassette which can be mounted sliding on transverse rails (not represented) arranged on the supporting frame 20 so as to be able to be separated laterally from the operator's side after decoupling from the extenders 44,46. After maintenance, each cassette, respectively lower 28 or upper 30, is returned to the leveling position inside the cage 20 and then coupling has to be reestablished between each leveling roller and the corresponding extender.

As shown schematically in FIG. 2, when using the leveling machine, the axes of the upper rollers 34 are placed at a height H2 and the coupling members 48 are centered on the axes of rollers at the same height H2. Similarly, the axes of the lower rollers 36 are placed at a height H1 and the coupling members 50 are centered on the axes of the lower rollers 36 at the same height H1.

In order to provide for nesting with no risk of deterioration of the interacting parts of each coupling member 48, 50 and each spindle 53, 52 of the corresponding roller 34, 36, the coupling members 48, 50 have to remain respectively at height H2 or H1 when mounting new cassettes which may be new, rectified or more suitable for the characteristics of the material to be leveled.

Thus, the leveling machine comprises means 101, 102, 103 for locking each removable coupling member 48, 50 at a predetermined height H2, H1 during device change phases. This locking is, in the embodiment in the figures, brought about by clamping each removable coupling member 48, 50.

According to the invention, the locking means 101, 102, 103 also comprise means for translationally moving the removable coupling members along the horizontal axis P of travel of the strip of material M. This characteristic makes it possible to obtain different separation distances or pitches between the rollers 36 and 34 and also to be able easily to install rollers with different diameters in the same leveling machine while retaining an isosceles triangle arrangement for the axes of the leveling rollers.

Figure 4:
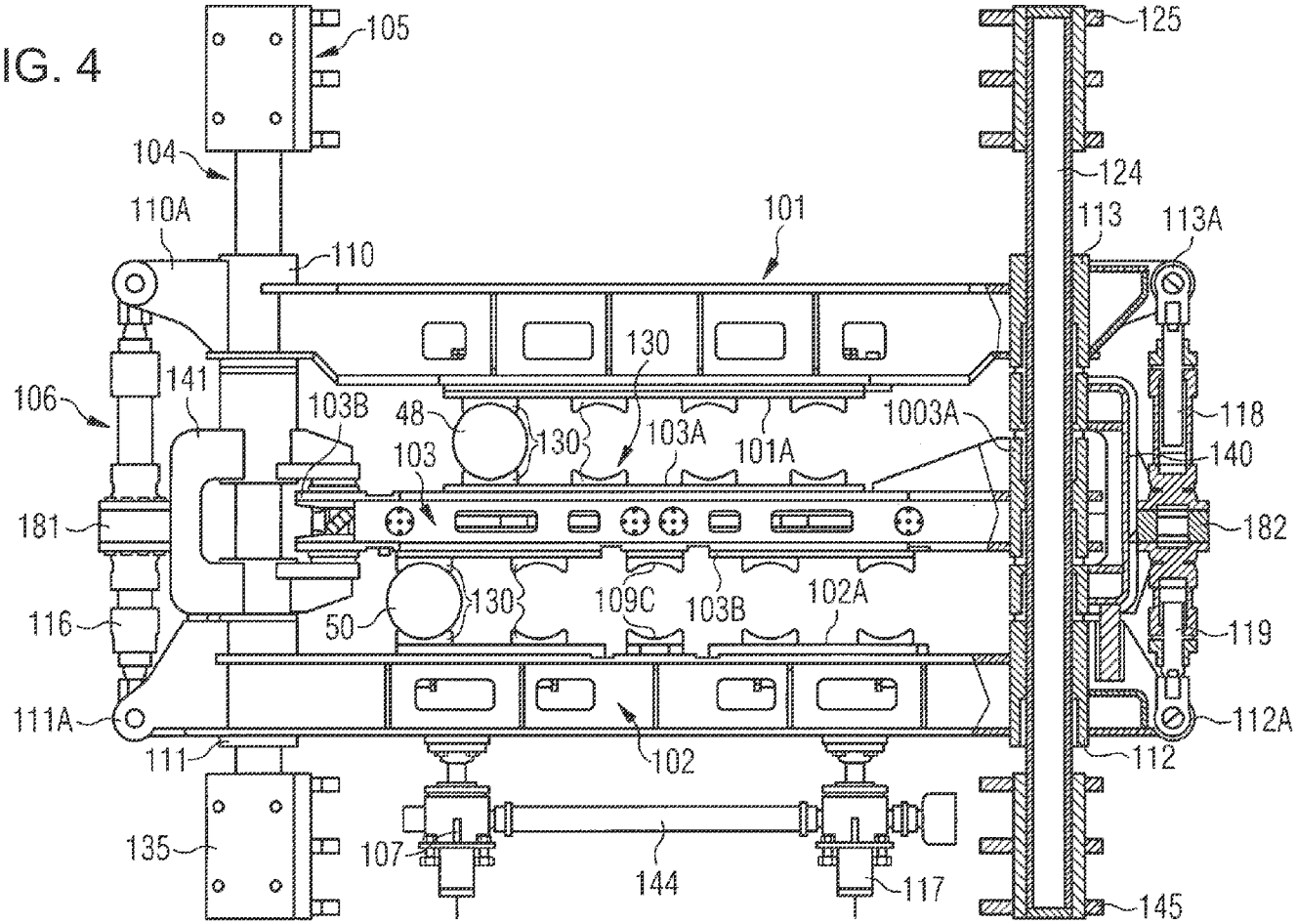
FIG. 4 is a front view of clamping and moving crosspieces for the removable leveling roller drive members.

FIG. 4 shows an embodiment of means 101, 102, 103 for locking each removable coupling member comprising means for translationally moving the removable coupling members along the direction of travel of the material M in the two directions defined by that direction. In other words, the movement means are suitable for moving in the same direction as the strip or in the opposite direction by driving the removable drive members.

The means for locking each removable coupling member 48, 50 in position comprise three horizontal crosspieces, an upper clamping crosspiece 101, a lower clamping crosspiece 102 and an intermediate clamping crosspiece 103 situated between the lower and upper crosspieces.

The upper 101 and lower 102 crosspieces extend longitudinally between two fixed vertical columns 104, 124 comprising at each of their ends supports 105, 125, 135, 145 intended to be fixed to two of the posts 22 of the leveling machine 15.

The upper 101 and lower 102 crosspieces comprise at each of their respective ends a hollow cylinder 110, 111, 112, 113 into which the fixed vertical axes 104, 124 are inserted, which thus act as translational guides for the crosspieces 101 and 102. Each hollow cylinder 110, 111, 112, 113 is firmly attached to a jack support portion 110A, 111A, 112A, 113A which accepts an end of a jack 106, 116, 118, 119 intended for moving the upper 101 and intermediate 103 clamping crosspieces.

The intermediate crosspiece 103 is rotated horizontally, for example under the action of a jack (not represented), about one of the guide axes 124 of the other crosspieces between a working position (as represented in FIG. 3) in which it extends in an imaginary plane passing through the fixed vertical axes 104, 124 and a resting position in which it extends outside the imaginary plane passing through the fixed vertical axes 104, 124. The intermediate clamping crosspiece 103 comprises at its pivoting end a hollow cylindrical portion 1003A into which the vertical column 124 acting as its axis of rotation is inserted. Each end of the cylindrical portion 1003A is in contact with a C-shaped translational guide 140 suitable for sliding along the column 124. The translational guide 140 is inserted between the hollow cylindrical portion 113 of the upper clamping crosspiece 101 and the hollow cylindrical portion 112 of the lower clamping crosspiece 102 and is in annular contact with each of these cylindrical portions. The translational guide 140 also comprises a portion 182 in the form of a plate extending in the direction opposite to that of the intermediate clamping crosspiece 103 when the latter is in its working position, as represented in FIG. 4. The plate 182 acts as a support for two jacks 118 and 119 for moving the clamping crosspieces 101 and 103.

The intermediate clamping crosspiece 103 comprises a free end 103B which, in working position, is accepted and locked between the two ends of a C-shaped translational guide 141 suitable for sliding along the column 104. The translational guide 141 is inserted between the hollow cylindrical portion 110 of the upper clamping crosspiece 102 and the hollow cylindrical portion 111 of the lower clamping crosspiece 102 and is in annular contact with each of these cylindrical portions. The translational guide 141 also comprises a portion 181 in the form of a plate extending in the direction opposite to that of the intermediate clamping crosspiece 103 when the latter is in its working position, as represented in FIG. 4. The plate 181 acts as a support for two jacks 106 and 116 for moving the clamping crosspieces 101 and 103.

In the example of an embodiment represented in FIG. 4, the lower crosspiece 102 rests on two mechanical jacks 107, 117 each mounted on a support fixed to a fixed element of the leveling machine 13, for example to the base 24. The two jacks 107, 117 are actuated synchronously by an extender system 144 driven by a motor. The lower clamping crosspiece 102 is thus guided vertically by the stems of the two jacks 107, 117 and can therefore be raised to take control of five coupling members or sleeves 50 of the lower extenders 46 in the position represented in FIG. 4.

The intermediate crosspiece 103 is placed perceptibly at the level of the axis of travel P of the product, between the two levels of the spindles 53, 52 on which the extenders 44, 46 engage. It can be moved horizontally between two positions, respectively a closed locking position for which the intermediate crosspiece extends transversely to the axes of the rollers between the coupling sleeves 48, 50 of the two series of extenders 44, 46 and an open position separated laterally, providing for vertical movements of the upper rollers 34 with the extenders in order to adjust the nesting of the leveling rollers 34, 36.

Each pair 106/116 and 118/119 of jacks is mounted head-to-tail between a jack support portion 110A, 111A, 112A, 113A and a portion 181 or 182 in the form of a plate of one of the translational guides 140 or 141, the base of each of the jacks being, in this embodiment, fixed to the plates 181 or 182 of the guides 141 or 140.

Figure 5:
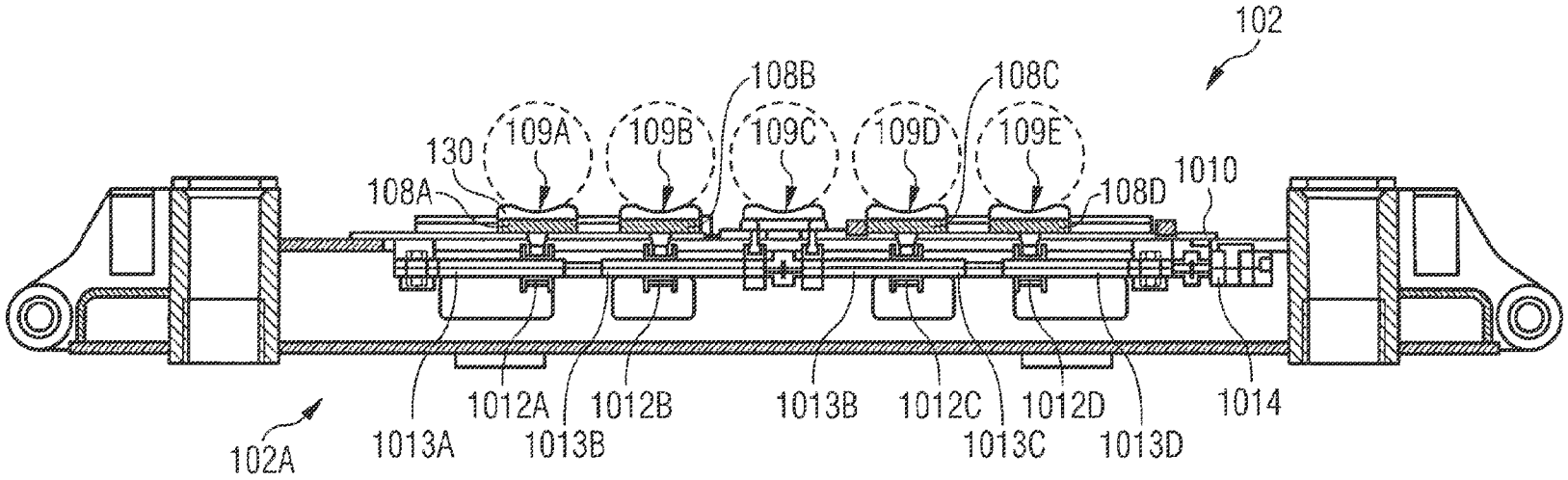
FIG. 5 is a sectional view of one of the clamping crosspieces in FIG. 4.

FIG. 5 is a longitudinal section view of a clamping crosspiece 102 showing details of an embodiment of the means for moving the removable coupling members. Of course, the other crosspieces also comprise means for moving similar to those which are now going to be described.

As shown in FIG. 5, the central part 102A of the crosspiece 102 is in the shape of a hollow parallelepiped forming a casing, and comprises an upper sliding surface 1010 defining a plurality of slots into which moving elements of general reference 130 are inserted, forming part of the means for moving the removable coupling members. In this embodiment, each moving element 130 comprises at least one support bearer 108A to 108D. Each support bearer 108A to 108D is free to slide translationally horizontally on the sliding surface guided by a slot which acts as a rail. Each support bearer 108A to 108D may take the form of a plate with a perceptibly rectangular shape. All the bearers installed on the same sliding surface of a crosspiece will subsequently be called a set of bearers.

Each bearer 108A to 108D carries on its upper face at least one clamping cradle 109A, 109B, 109D, 109E intended to cooperate with a removable coupling member 48, 50. The surface of each cradle 109A, 109B, 109D, 109E opposite the sliding surface 1010 has a curved shape complementary to that of the coupling member 48, 50 which it is intended to clamp. In this embodiment, each moving element 130 therefore comprises at least one bearer and one cradle.

Each support bearer 108A to 108D is firmly attached to a nut 1012A to 108D actuated by a screw 1013, itself operated by a rotation actuating member 1014. All the nuts firmly attached to a single set of bearers 108 are actuated by a single screw 1013. The nuts 1012A to 1012D and the screw 1013 are inserted into the protective casing formed by the central part 102A of the crosspiece 102, which prevents any fouling of these means for driving the bearers 108A to 108D and which also makes a saving in space.

In order to retain the isosceles triangle arrangement of the axes of the leveling rollers while providing for their movement, the screw 1013 comprises a plurality of guide sections for each nut, the thread characteristics of which differ.

Thus, the screw 1013 comprises, for each nut 1012A, 1012B, 1012C or 1012D which it guides, a threaded drive section 1013A, 1013B, 1013C or 1013D of a predetermined length, each section 1013A, 1013AB, 1013C, 1013D comprising a pitch and an inclination such that two moving bearers 109B/109D respectively 109A/109E situated at an equal distance from a point on the screw 1013, for example from the central point of the screw 1013, and on both sides of that point move, moving closer or further apart symmetrically with respect to that point when the screw is actuated. Furthermore, the choice of the pitch and inclination of the threads of screw 1013 is such that, when the screw is rotated in one direction, the bearers 108A to 108D move further apart while retaining their equal relative separation and, when the screw 1013 is rotated in the other direction, the bearers 108A to 108D move closer together while retaining their equal relative separation.

In the particular case of an odd number of cradles, as is the case in FIG. 5, the crosspiece 102 comprises a central fixed cradle 109C with no moving bearer. The moving bearers 108A to 108C then also move symmetrically with respect to this fixed cradle 109C. More precisely, the pitch and inclination of the thread of sections 1013B and 1013C of the screw provide for symmetrical movement of the support bearers 108A/108D and 108A/108C about the fixed position of the cradle 109C. Also, still to retain the isosceles triangle arrangement of the axes of the leveling rollers, the pitch and inclination of the thread of the screw are such that the distance covered by the support bearers 108A and 108D when the screw is actuated is double the distance covered by the support bearers 108B and 108C. Furthermore, in the example of an embodiment in FIG. 5, the two sections 1013B and 1013C have a reciprocal thread inclination, as are the inclinations of the two sections 1013A and 1013D.

As an example, the pitch of the sections 1013B and 1013C may be two millimeters, whereby the support bearers 108B and 108C move closer to or further away from the central cradle 109C, depending on the direction of rotation of the screw, by a distance of two millimeters per turn of the screw. In order to retain an equal pitch between the five cradles 109A to 109E, the two bearers 108A and 108D must move closer to or further away from the cradle 109C, depending on the direction of rotation of the screw, by a distance of four millimeters per turn of the screw. The pitch of the sections 1013D and 1013A is therefore four millimeters.

The screw 1013 of the clamping crosspiece 102 is actuated by remotely controlled rotation actuators 1014, which provide for the movement of the bearers 108A to 108D and therefore the modification of their relative positions as a function of the separation instructions for the leveling rollers 34 and 36. As an example, the rotation actuator 1014 for the screws may be an electric or hydraulic motor or a servomotor. Also, the screw 1013/nut 1012A to 1012D systems may be screw/ball nut systems.

As can be seen in FIG. 4, the upper clamping crosspiece 101 carries on its lower horizontal face 101A a first set of moving elements 130, the lower clamping crosspiece 102 carries on its upper horizontal face 102A a second set of moving elements 130 and the intermediate clamping crosspiece 130 carries on its upper horizontal face 103A a third set of moving elements 130 and carries on its lower horizontal face 103B a fourth set of moving elements 130. Each moving element 130 of the third set of moving elements 130 is positioned to come opposite to a moving element 130 of the first set of moving elements and each moving element of the fourth set of moving elements 130 is positioned to come opposite to a moving element of the second set of moving elements when the intermediate crosspiece is in working position. In the embodiment in FIG. 4, the intermediate crosspiece 103 carries on its lower face a fixed cradle 109C which aligns, in the working position of the intermediate crosspiece 103, with another fixed cradle 109C carried by the lower crosspiece 102. Also, the rotation drive member 1014 of each screw 1013 is controlled so that the moving elements 130 placed directly opposite move simultaneously by the same distance and in the same direction translationally to drive a removable coupling member 48 or 50, as a function of a separation instruction for the leveling rollers.

A description will now be given with reference to FIGS. 2, 6, 7A to 7D and 8A to 8D of the successive stages of adjustment of the distance between the leveling rollers 34 and 36, this distance also being called the pitch of the leveling rollers.

Figure 6:
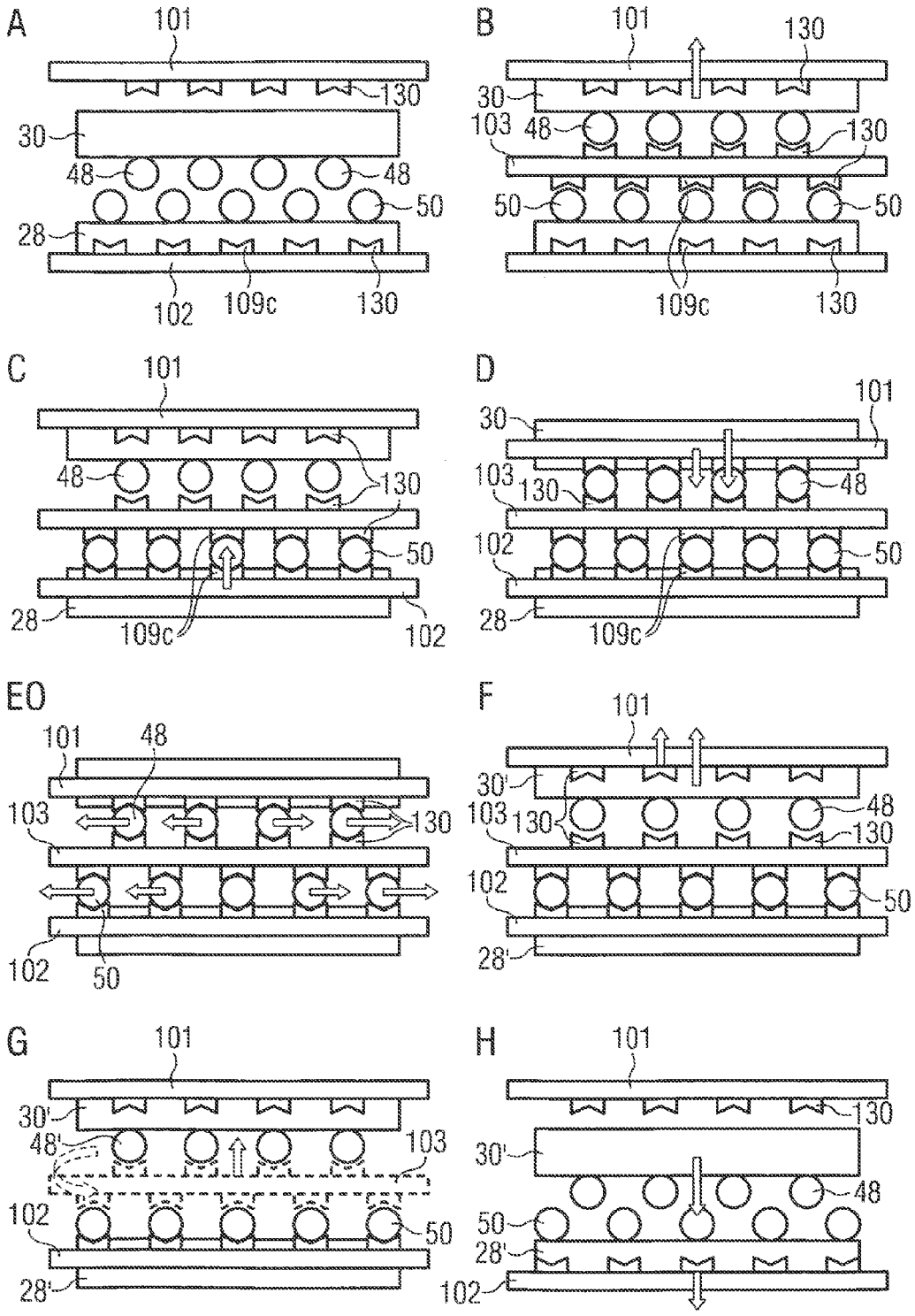
FIG. 6 is a schematic view of the stages of modification of the distance between the rollers of the leveling devices installed in a leveling machine.

The diagrams in FIG. 6 represent the movements of the different elements of the leveling machine seen from the leveling machine drive face, while the diagrams in FIGS. 2 and 7A to 7D represent the movements of the elements of the leveling machine 15 observed from the front of the leveling machine. FIGS. 8A to 8D represent the stages of evacuation of leveling devices which are worn or inappropriate for leveling a new strip of material and the stages for resupplying the machine with new devices.

During the stage marked A in FIG. 6, the upper 30 and lower 28 leveling devices are tightened in working position. The upper 101 and lower 102 clamping crosspieces are in resting position separated from the coupling members 48, 50 of the leveling rollers. As can also be seen in FIG. 2, in this configuration the upper clamping crosspiece 101 is in an entirely raised position, the lower crosspiece 102 in an entirely lowered position and the intermediate crosspiece 103 in retracted position. The upper leveling device 30 is firmly attached to the leveling machine 15 by four locking devices 13. Also, a transfer device 17 is in a position awaiting the leveling devices 28, 30 which are worn or unsuitable for leveling the next material. During these stages, the drive of the leveling rollers 28, 30 is stopped.

During the stage marked B in FIG. 6, the upper leveling device 30 rises under the action of the jacks 27, which lift the pressure frame 32, leaving sufficient space for the intermediate clamping crosspiece 103 to be brought from its resting position to its working position.

Figure 7A:
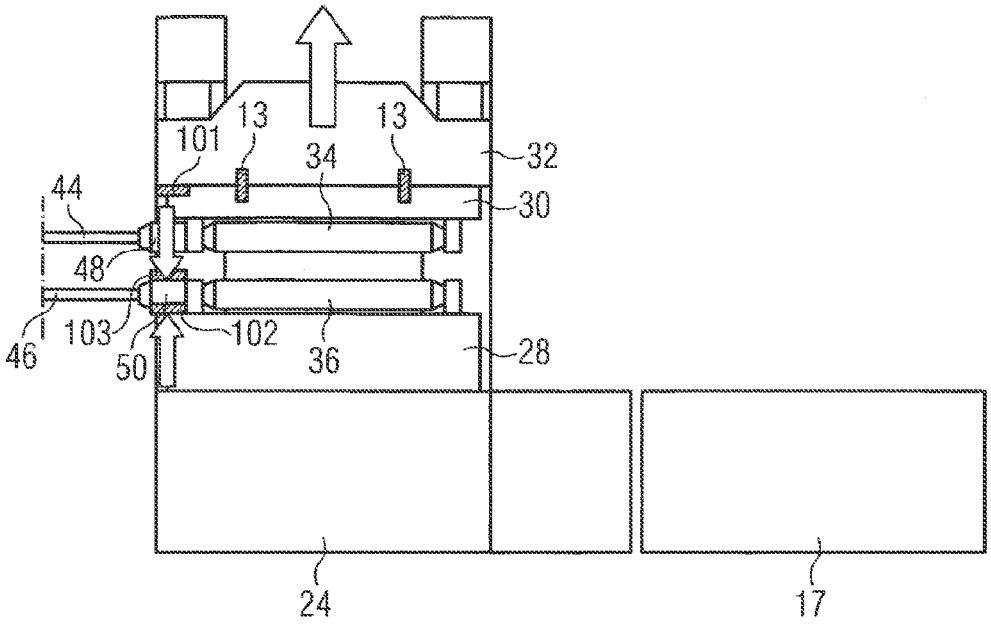
FIGS. 7A to 7D are schematic views of the stages of dismantling leveling devices.

During the stage marked C in FIG. 6, the lower clamping crosspiece 102 rises until it comes into contact with the lower coupling members 50 and the intermediate crosspiece 103 descends until it comes into contact with the same lower coupling members 50, thus providing for clamping of these lower coupling members 50. The position of the different elements of the leveling machine at the end of stage C is also represented in FIG. 7A.

Figure 7B:
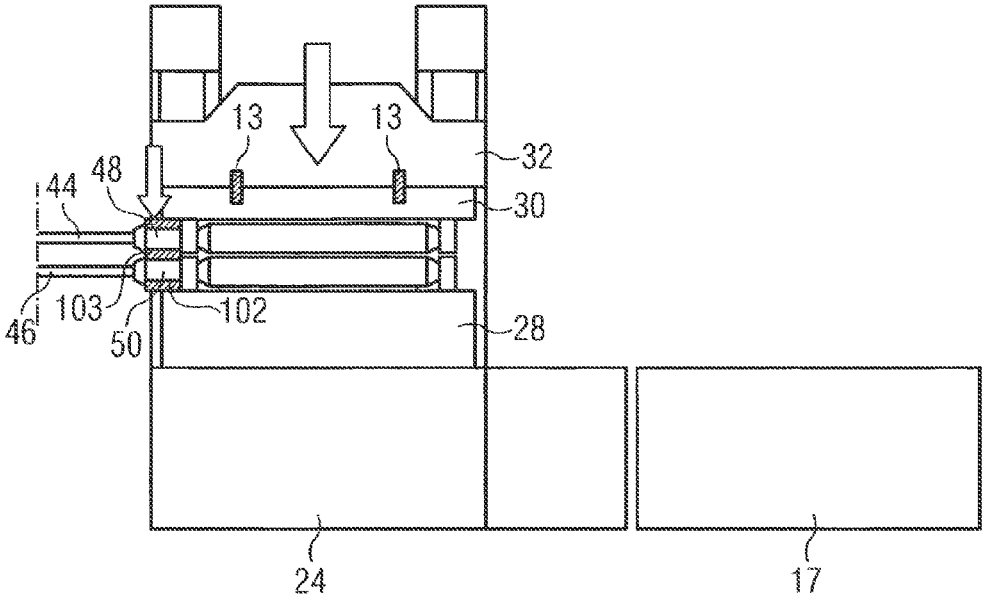

During the stage marked D in FIG. 6, the upper device 30 descends to allow for contact between the upper coupling members 48 and the intermediate clamping crosspiece 103 and then the upper clamping crosspiece 101 descends until it comes into contact with the same upper coupling members 48 thus providing for clamping of these upper coupling members 48. The position of the different elements of the leveling machine at the end of stage D is also represented in FIG. 7B.

According to the invention, the stage of clamping the removable coupling members 48, 50, providing for the transmission of torque to the leveling rollers to keep them at a predetermined height H1 or H2, comprises the stages B, C and D described previously.

During the stage marked E0 in FIG. 6, the support bearers 108 of the moving elements 130 are moved apart or together by controlling the actuators 1014 of each of the screws 1013 for the three crosspieces 101, 102, 103 in order to increase or reduce the pitch of the leveling rollers. More precisely, each removable coupling member 48, 50 clamped between two moving elements 130 is moved from a position corresponding to its position for coupling with the old roller 34, 36 to a new position for coupling with a new leveling roller in a new device 28', 30'.

Following stage E0, a succession of stages concerning the actual replacement of the leveling devices is implemented and these stages will now be described with reference to FIGS. 7C, 7D and 8A to 8D.

Figure 7C:
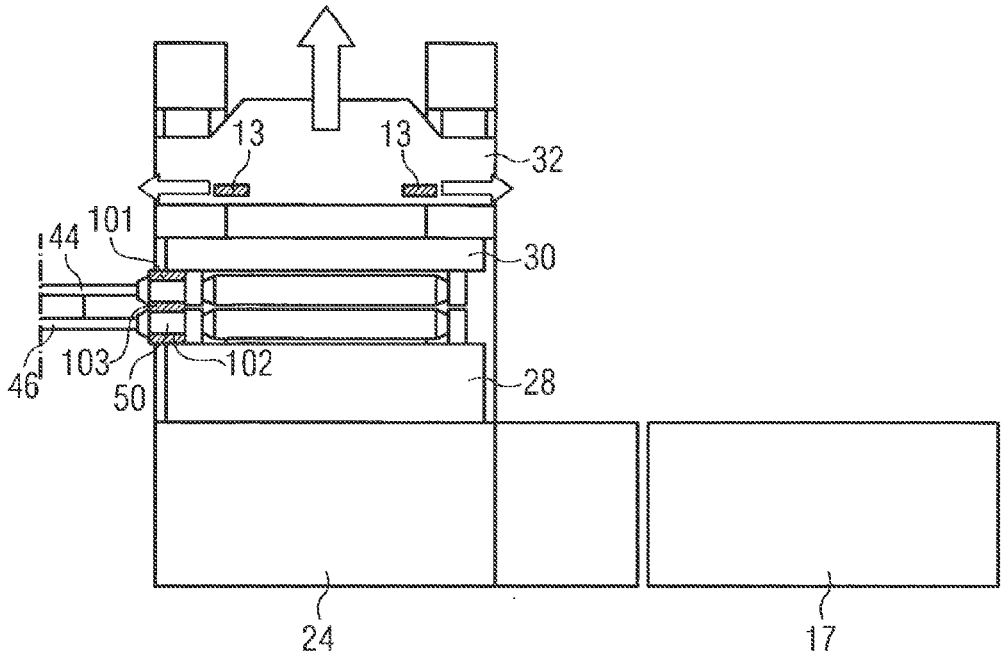

During stage E1 represented in FIG. 7C, the locking devices 13 are open, thus separating the pressure frame 32 from the upper leveling device 30 and then the pressure frame 32 rises again, released from the upper leveling device 32. In this position, the upper leveling device 30 rests on the lower leveling device 28.

Figure 7D:
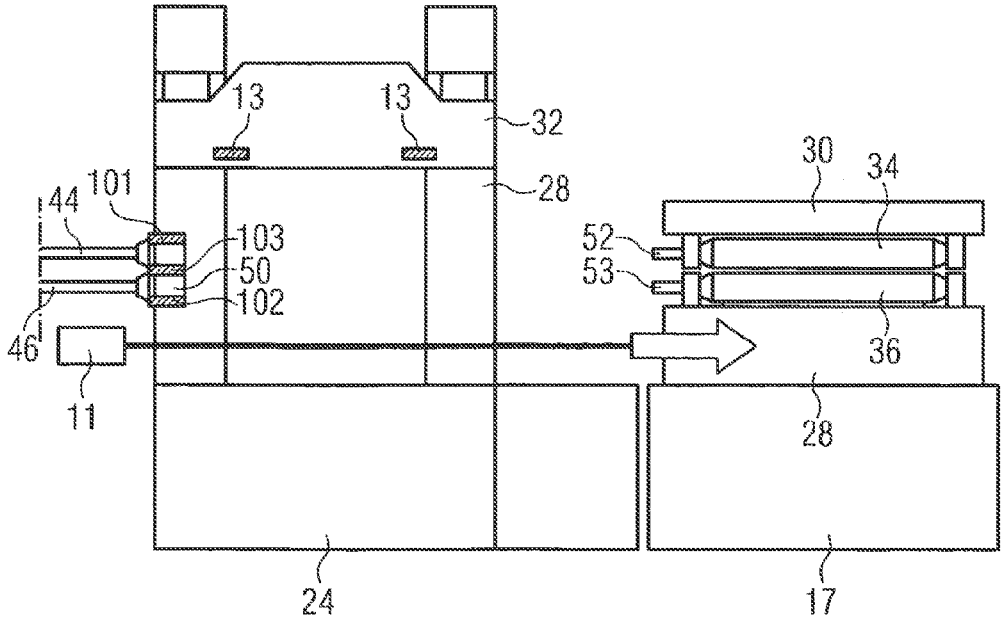

During stage E2 represented in FIG. 7D, the upper 30 and lower 28 leveling devices are pushed by extraction means 11 to a transfer device 17 and this brings about the extraction of the drive spindles 52, 53 of the leveling rollers 28, 30 out of the removable coupling members 48, 50. Stages E1 and E2 form the stage of extraction of the old leveling devices out of the leveling machine.

Throughout the entire duration of the preceding stages, the drive device 42 of the leveling machine 15 must be stopped and, in order to reduce this downtime, each of the two leveling devices 28 and 30, respectively lower or upper, is withdrawn en bloc from the leveling machine and has to be immediately replaced by a device carrying rollers which are new, rectified and suitable for the new material M to be leveled, the used device being transported to a workshop or simply a maintenance zone, where the various necessary maintenance operations are carried out.

FIGS. 8A to 8D are schematic top views of a leveling apparatus showing the different stages and the different means providing for a rapid change of leveling devices 28 and 30. In the views in FIG. 8, only the elements needed to understand the movements of the leveling devices have been represented.

Figure 8A:
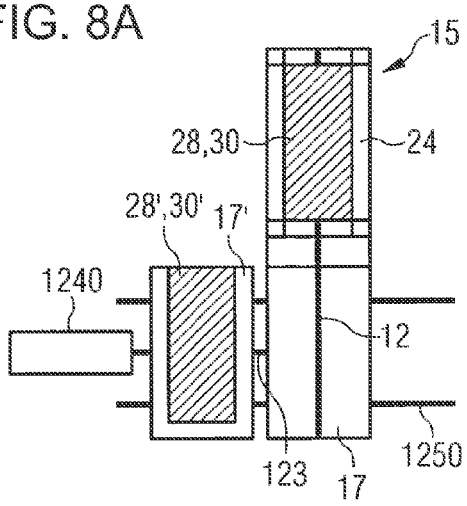
FIGS. 8A to 8D are schematic views of the stages of usage of leveling device transfer devices according to the invention.

In FIG. 8A, a set of upper 30 and lower 28 leveling devices is again installed on the fixed base 24 of the leveling machine 15, the upper leveling device 30 being placed on the lower leveling device. This view corresponds to the position which can be seen in FIG. 7C and to stage E1 described previously. A first transfer device 17 is installed in the extension of the fixed base, ready to accept the leveling devices 28 and 30 which are worn or inappropriate for leveling the next material M. A second transfer device 17' transporting a new set of upper and lower 28', 30' leveling devices is coupled to the transfer device 17 by means of a coupling 123. The leveling apparatus also comprises a jack 124 in contact with the transfer device 17'.

Figure 8B:
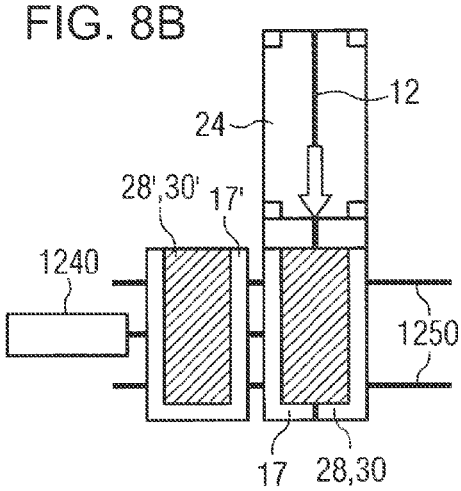

In FIG. 8B, the set of upper 30 and lower 28 leveling devices is pushed by the extraction means 11 (not represented in FIG. 8) to the transfer device 17, the set of leveling devices 28, 30 being guided by a rail 12 extending longitudinally into the base 24 and continuing below the transfer device 17. This view corresponds to the position which can be seen in FIG. 7D and to stage E2 described previously.

Figure 8C:
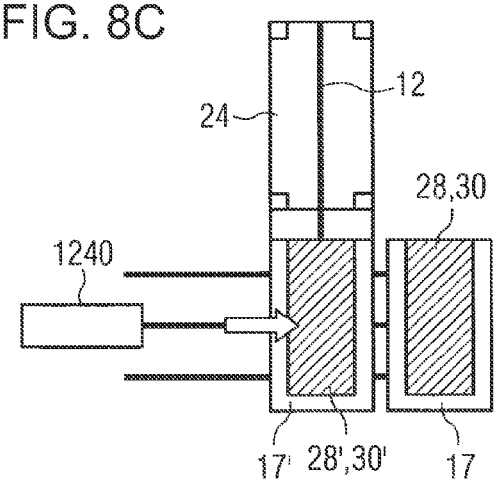

The method according to the invention comprises a stage E3 represented in FIG. 8C during which, the transfer jack 124$^5$ pushes the set of two transfer devices 17 and 17' on rails 125 until the transfer device 17' carrying the new leveling devices 28', 30' is in the extension of the fixed base 24 of the leveling machine 15.

Figure 8D:
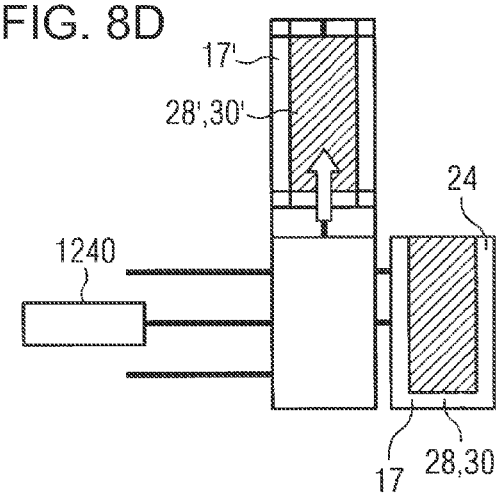

Then, during stage E4 represented in FIG. 8D, the new set of upper 30' and lower 28' leveling devices is drawn, for example by the extraction means 11, from a storage position to a working position on the fixed base of the leveling machine 15 until the drive spindles 52, 53 of the new leveling rollers 28', 30' are introduced into the removable coupling members 48, 50. Following this stage, the leveling machine 15 is fitted with new leveling devices 28', 30', the rollers of which are separated so as to provide for the optimum leveling of a material with new characteristics. Stages E3 and E4 constitute, in this embodiment, the stage of introduction of the new leveling devices 28', 30' into the leveling machine 15. We are again in the position marked E0 in FIG. 6.

With the new leveling devices 28' and 30' installed on the fixed base 24, in stage E5 the pressure frame 32 descends again and the new upper leveling device 30' is firmly attached to the pressure frame 32 by means of the locking devices 13. We are again in the configuration in FIG. 7B, this time with the new leveling devices 28' and 30'.

The clamping crosspieces now have to be returned to their resting position, so, during the stage marked F in FIG. 6, the upper clamping crosspiece 101 rises again to resting position and thus releases the upper coupling members 48 and then the new upper device 30' also rises again, driven by the pressure frame 32.

During the stage marked G in FIG. 6, the intermediate clamping crosspiece 103 rises again to its resting position and then pivots about its axis of rotation 124.

During the stage marked H in FIG. 6, the lower clamping crosspiece 102 descends to its resting position and then the new upper leveling device 30' descends to its working position.

Stages F, G and H constitute, in this embodiment, the stage of release of the removable coupling members.

After the stage of releasing the removable coupling members, during stage I the pressure frame 32 descends once more, driving the new leveling device 30' to obtain the desired nesting between the new leveling devices for leveling the new material. Then, the motor 47 driving the leveling rollers is restarted.

The leveling machine is again in working position and can level a new material, having new leveling rollers 48' and 50' comprising a separation and diameter suitable for the characteristics of the new material M to be leveled.

Figure 9A:
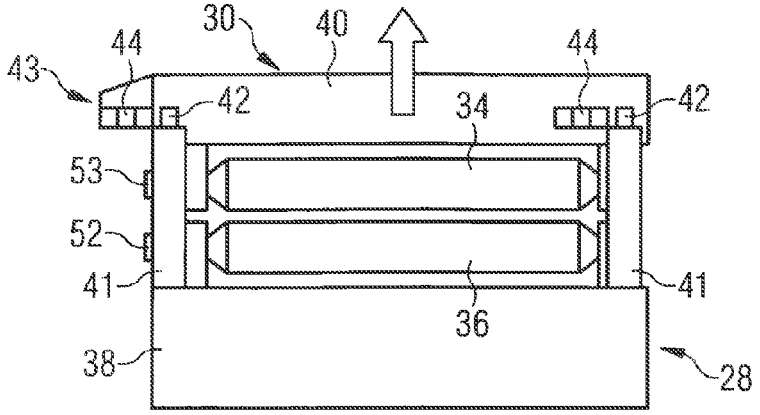
FIGS. 9A to 9C are schematic views of an embodiment of leveling devices according to the invention.
Figure 9B:
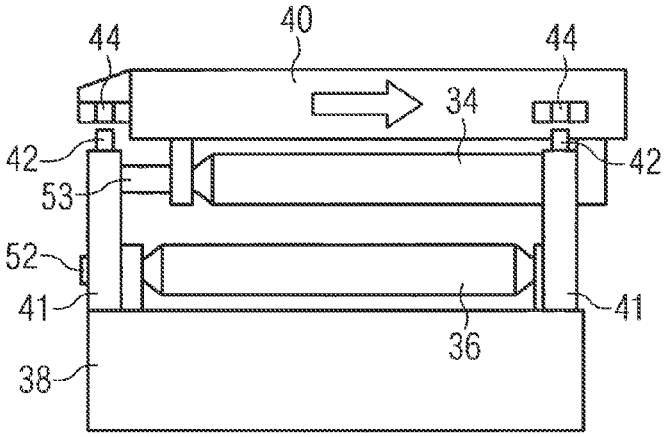
Figure 9C:
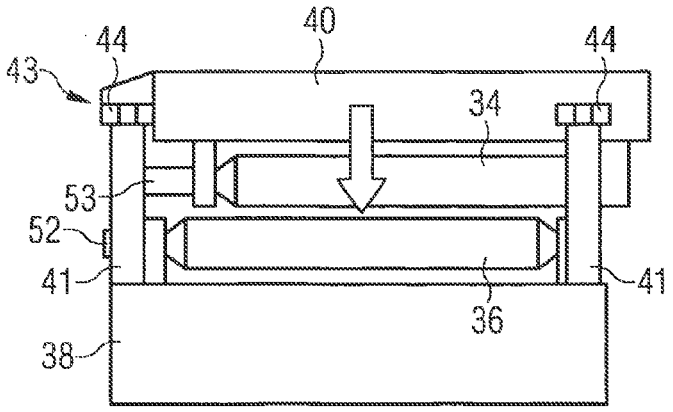

FIGS. 9A to 9C represent a particular embodiment of the lower 28 and upper 30 leveling devices providing for safe docking of the upper device to the lower device during the phases of extraction, introduction and transfer of the leveling devices. This embodiment makes it possible to prevent any relative movement of one device with respect to the other.

For better understanding, only the leveling devices 28 and 30 are represented in FIGS. 9A to 9C.

As can be seen in FIG. 9A, each leveling device comprises a plurality of leveling rollers 34, 36 terminated at their drive end by spindles 52, 53. Also, the lower leveling device 28 comprises at least four beams 41 extending vertically from the frame 38 and terminated in their upper part by two pins 42.

The upper leveling device 30 comprises at least two pinning plates 43 each pierced by at least one borehole 44.

In FIG. 9A, the two upper 30 and lower 28 leveling devices are represented in working position.

During the extraction operations and as represented in FIG. 9B, the upper leveling device is first raised so that the lower face of its plates 43 is higher than the upper end of the pins 42 and then it is translationally moved in order to make the pins 42 align with the boreholes 44. It is also possible that it is the lower leveling device 28 which is moved, for example by translational movement, so that the upper ends of its pins 42 align with the boreholes 44.

The upper leveling device is then placed on the lower leveling device, the two devices being pinned together by introducing the pins 42 into the boreholes 44.

When leveling devices according to the last embodiment are installed in the leveling machine 15, the method according to the invention comprises an additional stage C' between the stage C and stage D described previously and stages E4', E5', F' and F" replace the stages E4, E5 and F described above. During this stage C', the lower leveling device 28 is translationally moved perpendicular to the direction of travel of the material M, for example by the extraction means 11 which can be seen in FIG. 7D from its working position to an intermediate position in which the pins 42 align with the boreholes 44. This translational movement also provides for the at least partial extraction of the drive spindles 52 of the lower leveling rollers 36 out of the lower removable coupling members 50. In this configuration, the lower removable coupling members 50 are again at height H1, clamped between the intermediate clamping crosspiece 103 and the lower clamping crosspiece 102.

Then, when, at the stage D described previously, the upper device descends to allow contact between the upper coupling members 48 and the intermediate clamping crosspiece 103, the pins 42 penetrate into the boreholes 44 and the two leveling devices are safely docked to one another. The rest of stage D is then carried out.

During stage E4', new lower 28' and upper 30' leveling devices pinned together according to the embodiment in FIG. 9C are pushed onto the fixed base of the leveling machine 15 until the drive spindles 53 of the upper leveling rollers are introduced into the upper extender couplings 48. We are again in the configuration in FIG. 8D except that the new lower 28' and upper 30' leveling devices are pinned together according to the embodiment in FIG. 9C.

During stage E5', the pressure frame 32 descends again and the new upper leveling device 30' is firmly attached to the pressure frame 32 by means of the locking devices 13.

The clamping crosspieces now have to be returned to their resting position, thus, during stage F', the upper clamping crosspiece 101 rises again to resting position and releases the upper coupling members 48 and then the new upper device 30' also rises, driven by the pressure frame 32.

In stage F", the new lower leveling device 28' is translationally moved perpendicular to the direction of travel of the strip from its dismantling position until the drive spindles 52 of the lower leveling rollers are introduced into the lower extender couplings 50. Stages G et seq are then carried out.

The machine, the apparatus and the method according to the invention thus provide for rapid change of the pitch of the leveling rollers, change in the diameter of the leveling rollers, combined or otherwise with a change in pitch, mounting of devices with one or more pairs of upper and lower rollers of less than the maximum capacity of the apparatus. For example, seven or five rollers of large diameter in an apparatus able to accommodate and rotate nine of them.

The invention claimed is:

1. A leveling machine for leveling a strip of material, comprising:

a fixed supporting frame including four posts disposed on each side of a longitudinal axis of travel of the material, a fixed base firmly holding said posts in a lower part thereof, and transverse beams firmly holding said posts in an upper part thereof, with an assembly of said posts, said base, and said beams forming a closed frame;

a lower leveling device resting on said fixed base and an upper leveling device resting on a pressure frame disposed for vertical movement between said four posts, each said leveling device forming a cassette with a plurality of separated rollers, rotatably mounted on a frame around axes perpendicular to the longitudinal axis of travel of the material;

a rotating device for rotating said rollers connected to at least some of said rollers by way of an extender, each extender having a first end rotated and a second end fitted with a removable coupling member with one end driving a roller, said extenders being disposed on two levels, including a lower level coupling with said rollers of said lower leveling device and an upper level coupling with said rollers of said upper leveling device;

a locking device for locking each removable coupling member by clamping at a predetermined height during device changing phases;

said locking device including moving devices configured to translate said removable coupling members in the direction of travel of the material and in the opposite direction; and a dismantling device for dismantling each of said upper and lower leveling devices by moving, perpendicular to the axis of travel, between a working position inside said frame and a withdrawn position offset laterally on one side of the frame opposite a drive side thereof.

2. The leveling machine according to claim 1, wherein said moving devices for moving said removable coupling members comprise a plurality of elements translationally moving between two end positions, configured for moving said removable coupling members.

3. The leveling machine according to claim 2, wherein said clamping locking device comprises:

an upper clamping crosspiece having a lower horizontal face carrying a first set of translationally moving elements;

a lower clamping crosspiece having an upper horizontal face carrying a second set of translationally moving elements; and an intermediate clamping crosspiece positioned between said lower and upper crosspieces and having an upper horizontal face carrying a third set of translationally moving elements and a lower horizontal face carrying a fourth set of translationally moving elements.

4. The leveling machine according to claim 3, wherein each of said moving elements comprises a moving bearer configured for sliding on a sliding surface of the respectively supporting said crosspiece, each bearer carrying at least one clamping cradle configured for clamping a removable said coupling member.

5. The leveling machine according to claim 4, wherein each of said moving elements comprises a nut integral with said bearers of the moving element, the nuts belonging to a same set of moving elements being moved by a single screw, said screw being actuated by a rotating member.

6. The leveling machine according to claim 5, wherein said screw comprises, for each nut guided thereby, a threaded drive section of a predetermined length, each section comprising a pitch and an inclination such that two moving bearers situated at an equal distance from a point on said screw and on both sides of said point move, thereby moving closer or farther apart symmetrically with respect to said point when said screw is actuated.

7. The leveling machine according to claim 6, wherein the pitch and the inclination of said threads are configured such that, when said screw is rotated in one direction, said bearers of one set move farther apart while retaining their equal relative separation and, when said screw is rotated in an opposite direction, said bearers of one set move closer together while retaining their equal relative separation.

8. The leveling machine according to claim 3, wherein said upper and lower crosspieces are translationally guided by two fixed vertical axles, said axles having respective ends with supports fixed to two of said posts, said intermediate crosspiece horizontally rotating about one of said guide axles of the other crosspieces between a working position in which said intermediate crosspiece extends in a plane passing through the fixed vertical axes and a resting position in which it extends outside the plane passing through the fixed vertical axes.

9. The leveling machine according to claim 8, wherein, in the working position of said intermediate clamping crosspiece, each moving element of the first set of said moving elements is placed opposite a moving element of the third set of said moving elements and each moving element of the second set of said moving elements is placed opposite a moving element of the fourth set of moving elements, said rotating member of each screw being controlled so that said moving elements placed directly opposite move simultaneously an equal distance and in the same direction in order to translate a removable coupling member.

10. The leveling machine according to claim 3, wherein each clamping crosspiece comprises a hollow part forming a protective casing for a portion of said moving elements supported thereon.

11. The leveling machine according to claim 3, wherein at least two of said clamping crosspieces comprise a fixed cradle disposed on a sliding surface of each of said clamping crosspieces in a center of said moving elements, each clamping cradle coming into a position opposite another fixed clamping cradle when said clamping crosspieces are in working position.

12. The leveling machine according to claim 3, wherein said upper clamping crosspiece and said lower clamping crosspiece comprise at each of their ends a hollow cylinder accepting fixed vertical axes acting as a translational guide for said upper and lower crosspieces.

13. The leveling machine according to claim 1, wherein said lower leveling device comprises at least four beams extending vertically from said lower frame and terminated in an upper part thereof by pins, said upper leveling device comprising at least two pin plates each being pierced by at least one borehole, said pins of said lower leveling device being configured for insertion into said boreholes of said upper leveling device to provide for docking of said upper leveling device with said lower leveling device during phases of extraction, introduction and transfer of said leveling devices.

14. A leveling apparatus, comprising:

a leveling machine according to claim 1;

a first transfer device configured to accept leveling devices that are worn or inappropriate for leveling further material and that originate from said leveling machine;

a second transfer device transporting a new set of upper and lower leveling devices coupled to said first transfer device by way of a coupling; and a jack in contact with said second transfer device and configured for moving a set of said first and second transfer devices from a position in which said first transfer device is installed in an extension of said fixed base on rails to a position in which said second transfer device carrying the new leveling devices is in the extension of said fixed base of said leveling machine.

15. A method of modifying a distance between the rollers of leveling devices in a leveling machine, the leveling machine comprising:

a fixed supporting frame with four posts disposed laterally of a longitudinal axis of travel of a material to be processed in the leveling machine and firmly held between a fixed base and transverse beams, the assembly forming a closed frame;

a lower leveling device resting on the fixed base and an upper leveling device resting on a pressure frame which can be moved vertically between the four posts, each leveling device forming a cassette with a plurality of separated rollers, rotatably mounted on a frame around axes perpendicular to the longitudinal axis of travel of the material;

means for rotating the rollers connected to at least some of the rollers by an extender, each extender having a first end rotated and a second end fitted with a removable coupling member with one end driving a roller, the extenders being arranged on two levels, respectively a lower level coupling with the rollers of the lower device and an upper level coupling with the rollers of the upper device;

means for locking each removable coupling member by clamping at a predetermined height during device changing phases; and means for dismantling each of the two leveling devices by moving, perpendicular to the axis of travel, between a working position inside the frame and a withdrawn position offset laterally on one side of the frame;

the method which comprises the following steps:

clamping each removable coupling member providing for the transmission of torque to the rollers of the leveling devices to keep them at a predetermined height;

extracting old leveling devices from the leveling machine, during which each end driving a roller is extracted from its removable coupling member;

translating each removable coupling member in the direction of travel of the material or in the opposite direction, from a position corresponding to the position of coupling with one of the rollers of an old leveling device to a new position of coupling with one of the rollers of a new leveling device;

introducing the new leveling devices into the leveling machine during which each end driving a new roller is engaged in a removable coupling member; and releasing the removable coupling members.

16. The method according to claim 15, wherein it comprises, prior to the step of clamping the removable coupling members, a step of stopping the rotation of the leveling rollers.

17. The method according to claim 15, wherein the step of clamping the removable coupling members comprises:

a step B during which the upper device rises from a working position thereof to a high position and during which an intermediate clamping crosspiece is taken from its resting position to a working position in which the intermediate clamping crosspiece extends in a plane passing through two fixed vertical translational guide axes of the other crosspieces;

a step C during which a lower clamping crosspiece of the leveling machine rises to contact the lower removable coupling members and during which the intermediate crosspiece descends to come into contact with the same lower coupling members thus providing for clamping of the lower coupling members;

a step D during which the upper leveling device descends to provide for contact between the upper coupling members and the intermediate clamping crosspiece and during which an upper clamping crosspiece descends to come into contact with the same upper coupling members thus providing for clamping of the same upper coupling members.

18. The method according to claim 17, which comprises, prior to step D, translating the lower leveling device perpendicularly to the direction of travel of the material, for example by a means of extraction, from the working position to an intermediate position in which pins of the lower leveling device are opposite boreholes of the upper leveling device.

19. The method according to claim 15, wherein the extracting step comprises:

opening locking devices, thus releasing the pressure frame and the upper leveling device and raising the pressure frame;

pushing the upper and lower leveling devices by an extraction device to a transfer device, which brings about the extraction of the ends driving the leveling rollers out of the removable coupling members.

20. The method according to claim 15, wherein a step during which each removable coupling member is moved comprises a step of moving a plurality of moving elements belonging to each of the clamping crosspieces, each moving element accepting a removable coupling member, the movement of each moving element being from a position corresponding to the position for coupling the removable coupling member with one of the rollers of the old leveling devices to a new position for coupling the removable coupling member with one of the rollers of the new leveling devices.

21. The method according to claim 15, wherein the step of introducing the new leveling devices into the leveling machine comprises:

a step E3 during which a transfer jack pushes an assembly comprising two transfer devices carrying respectively leveling devices which are worn or not suitable for leveling a strip of material emerging from the leveling machine and new leveling devices on rails until the transfer device carrying the new leveling devices is in the extension of the fixed base of the leveling machine;

a step E4 during which the new upper and lower leveling devices are drawn by extraction from a storage position to a working position on the fixed base of the leveling machine until the ends driving the new leveling rollers are introduced into the removable coupling members; and a step E5 during which the pressure frame descends again and during which the new upper leveling device is firmly attached to the pressure frame by way of the locking devices.

22. The method according to claim 15, wherein the step of releasing the removable coupling members comprises:

a step F during which an upper clamping crosspiece rises again to a resting position, thus releasing the upper coupling members and during which the new upper device also rises again, driven by the pressure frame;

a step G during which an intermediate clamping crosspiece rises again to the resting position thereof and then pivots about its axis of rotation;

a step H during which a lower clamping crosspiece descends to the resting position thereof and during which the new upper leveling device descends to its working position.

23. The method according to claim 15, wherein the step of introducing the new leveling devices into the leveling machine comprises:

a step E3 during which a transfer jack pushes an assembly comprising two transfer devices carrying respectively leveling devices that are worn or not suitable emerging from the leveling machine and new leveling devices on rails until the transfer device carrying the new leveling devices is in a extension of the fixed base of the leveling machine;

a step E4', during which the new lower and upper leveling devices pinned together are pushed onto the fixed base of the leveling machine until the ends driving the upper leveling rollers are introduced into the upper removable coupling members; and a step E5' during which the pressure frame descends again and during which a new upper leveling device is firmly attached to the pressure frame by way of the locking devices.

24. The method according to claim 23, wherein the step of releasing the removable coupling members comprises:

a step F' during which an upper clamping crosspiece rises again to a resting position, thus releasing the upper coupling members and during which the new upper device also rises again, driven by the pressure frame, a step F" during which the new lower leveling device is translated perpendicularly to the direction of travel of the strip from a dismantling position thereof until the ends driving the lower leveling rollers are introduced into the lower removable coupling members;

a step G during which an intermediate clamping crosspiece rises again to the resting position thereof and then pivots about its axis of rotation;

a step H during which a lower clamping crosspiece descends to the resting position thereof and during which the new upper leveling device descends to the working position thereof.

* * * * *